US006684954B2

(12) United States Patent
George

(10) Patent No.: US 6,684,954 B2
(45) Date of Patent: Feb. 3, 2004

(54) BI-DIRECTIONAL EXPLOSIVE TRANSFER SUBASSEMBLY AND METHOD FOR USE OF SAME

(75) Inventor: Flint R. George, Flower Mound, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/999,511

(22) Filed: Oct. 19, 2001

(65) Prior Publication Data

US 2003/0075317 A1 Apr. 24, 2003

(51) Int. Cl.[7] ..... E21B 43/1185
(52) U.S. Cl. ..... 166/297; 166/55.1; 175/4.51
(58) Field of Search ..... 175/4.54, 4.56, 175/57; 166/297, 55; 102/312

(56) References Cited

U.S. PATENT DOCUMENTS

| | | | | | |
|---|---|---|---|---|---|
| 3,040,808 | A | * | 6/1962 | Schramm et al. | 175/4.54 |
| 4,153,118 | A | * | 5/1979 | Hart | 166/297 |
| 4,425,965 | A | | 1/1984 | Bayh, III et al. | 166/106 |
| 4,529,035 | A | | 7/1985 | Bayh, III | 166/106 |
| 4,625,798 | A | | 12/1986 | Bayh, III | 166/106 |
| 5,033,553 | A | * | 7/1991 | Miszewski et al. | 175/4.51 |
| 5,603,379 | A | | 2/1997 | Henke et al. | 166/297 |
| 6,273,187 | B1 | | 8/2001 | Voisin, Jr. et al. | 166/63 |
| 2003/0102122 | A1 | * | 6/2003 | Vargervik et al. | 166/55.1 |

* cited by examiner

*Primary Examiner*—David Bagnell
*Assistant Examiner*—Matthew J Smith
(74) *Attorney, Agent, or Firm*—Lawrence R. Youst

(57) ABSTRACT

A bi-directional explosive transfer subassembly (56) for coupling two explosive tools (52, 54) comprises first (74, 78) and second (76, 80) explosive carrying members that respectively define first (82, 86) and second (84) explosive cavities. A ball end (102) of the first explosive carrying member (74, 78) is slidingly received in a socket (114) of the second explosive carrying member (76, 80) such that the first (74, 78) and second (76, 80) explosive carrying members are rotatable and angularly displaceable relative to one another. A first explosive device (130) is disposed in the first explosive cavity (82, 86) and a second explosive device (132) is disposed in the second explosive cavity (84). The first (130) and second (132) explosive devices are spaced apart such that when one of the explosive devices (130, 132) is initiated, the other of the explosive devices (130, 132) will in turn be initiated.

41 Claims, 3 Drawing Sheets

BI-DIRECTIONAL EXPLOSIVE TRANSFER SUBASSEMBLY AND METHOD FOR USE OF SAME

TECHNICAL FIELD OF THE INVENTION

This invention relates, in general, to perforating a subterranean wellbore using shaped charges and, in particular, to a bi-directional explosive transfer subassembly that is installed within a work string between loaded perforating guns for use in deviated wellbores.

BACKGROUND OF THE INVENTION

Without limiting the scope of the present invention, its background will be described with reference to perforating a subterranean formation using shaped charge perforating guns, as an example.

After drilling the section of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic opening or perforation must be made through the casing string, the cement and a short distance into the formation.

Typically, these perforations are created by detonating a series of shaped charges located within the casing string that are positioned adjacent to the formation. Specifically, numerous charge carriers are loaded with shaped charges that are connected with a detonating device, such as detonating cord, forming perforating guns. The perforating guns are then connected within a tool string that is lowered into the cased wellbore. Once the perforating guns are properly positioned in the wellbore such that the shaped charges are adjacent to the formation to be perforated, the shaped charges are detonated. Upon detonation, each shaped charge creates a jet that blasts through a scallop or recess in the charge carrier, creates a hydraulic opening through the casing and cement and then penetrates the formation forming a perforation therein. Typically, the shaped charges are fired from the near end to the far end of the formation. In the event of a misfire of the shaped charges, however, it may be necessary to reverse the firing sequence to fire the shaped charges from the far end to the near end of the formation.

It has been found that it is sometimes difficult to deploy the desired length of perforating guns into highly deviated or horizontal wells and wells with restrictions. Specifically, in such well configurations, large bending moments act on the string of perforating guns in the plane parallel to the centerline of the perforating guns. These large bending moments can cause failures at the connections between perforating guns, which may result in misfiring. In addition, these large bending moments can prevent relative rotation of the perforating guns about the centerline of the perforating guns such that it is difficult or impossible to orient the perforating guns to fire in the desired direction.

A need has therefore arisen for an apparatus that allows a string of perforating guns to be run into highly deviated or horizontal wells and wells with restrictions. A need has also arisen for such an apparatus that allows for the proper orientation of the perforating guns so that they fire in the desired direction. Further, a need has arisen for such an apparatus that allows for bi-directional firing of the perforating guns.

SUMMARY OF THE INVENTION

The present invention disclosed herein comprises a bi-directional explosive transfer subassembly that can be installed within a tool string between two live perforating guns that allows a string of perforating guns to be deployed into a highly deviated well, a horizontal well or a well with restrictions. In addition, the bi-directional explosive transfer subassembly of the present invention allows for the proper orientation of the perforating guns so that they fire in the desired direction.

The bi-directional explosive transfer subassembly of the present invention comprises a first explosive carrying member having a ball end and a first explosive cavity and a second explosive carrying member having a socket and a second explosive cavity. The ball end of the first explosive carrying member is slidingly received in the socket of the second explosive carrying member such that the first and second explosive carrying members are rotatable and angularly displaceable relative to one another. A first explosive device including, for example, a first shaped charge is disposed in the first explosive cavity. A second explosive device including, for example, a second shaped charge is disposed in the second explosive cavity. The first and second explosive devices are spaced apart such that the first and second shaped charges face one another and are each adapted for sending an explosive jet toward the other shaped charge, thereby providing an explosive transfer therebetween. Accordingly, when one of the first and second explosive devices is initiated, the other of the first and second explosive devices will in turn be initiated.

The first explosive carrying member of the bi-directional explosive transfer subassembly may include a cylindrical portion extending integrally from the ball end. The second explosive carrying member may include a flange portion extending from the socket that has a conically shaped inner surface having an angle that defines the maximum allowable angular displacement between the first and second explosive carrying members. Specifically, the maximum allowable angular displacement occurs when the cylindrical portion of the first explosive carrying member contacts the flange portion of the second explosive carrying member. The maximum angular displacement between the first and second explosive carrying members may be between about 1 and about 10 degrees and is preferably about 5 degrees.

The first and second explosive cavities of the bi-directional explosive transfer subassembly are separated by portions of the first and second explosive carrying members. For example, the first and second explosive carrying members may respectively include first and second wall portions that are adjacent to one another, thereby separating the first and second explosive cavities. Both the first and second explosive devices of the bi-directional explosive transfer subassembly may include a booster, a length of detonating cord connected to the booster and a detonating cord initiator connected to the detonating cord.

In one embodiment, the bi-directional explosive transfer subassembly is positioned between first and second perforating guns in a well perforating apparatus. In this embodiment, the sliding engagement between the ball end of the first explosive carrying member in the socket of the second explosive carrying member provides for rotation and angular displacement of the first and second perforating guns relative to one another. Also in this embodiment, when one of the first and second explosive devices is initiated, the other of the first and second explosive devices will in turn be initiated thereby transferring explosive between the first and second perforating guns.

The bi-directional explosive transfer subassembly is also used in a method of perforating a well. Specifically, the method comprises deploying a string of perforating guns in a wellbore, the string having first and second perforating guns with a bi-directional explosive device disposed therebetween providing relative rotation and angularly displace therebetween. The method also comprises firing one of the first and second perforating guns, igniting one of the first and second explosive devices, igniting the other of the first and second explosive devices and firing the other of the first and second perforating guns, thereby transferring the explosive and sequentially firing the string of perforating guns.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
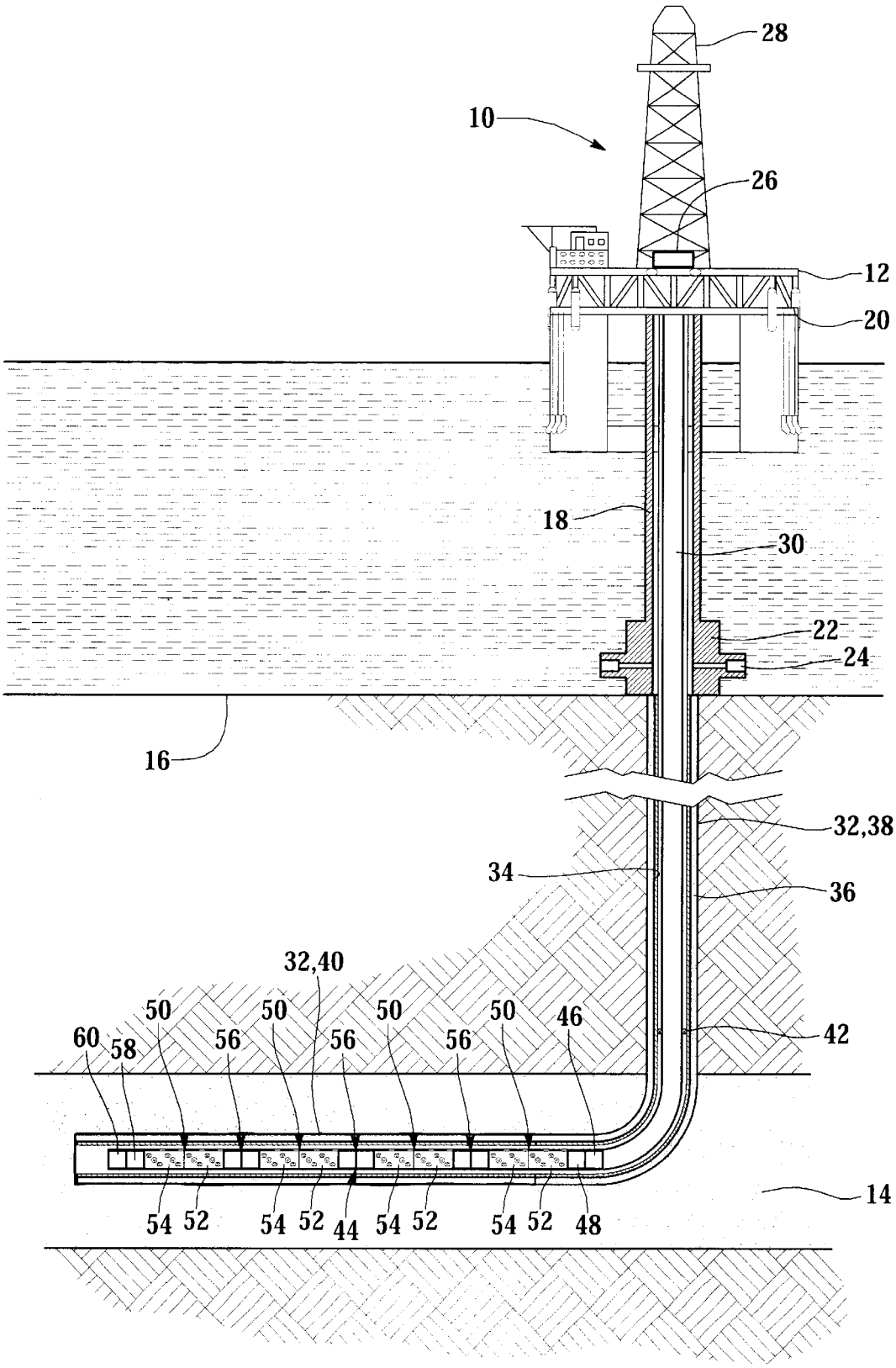
FIG. 1 is a schematic illustration of an offshore oil and gas platform operating a plurality of bi-directional explosive transfer subassemblies of the present invention that are disposed between perforating guns in a work string.

Referring initially to FIG. 1, a plurality of bi-directional explosive transfer subassemblies of the present invention operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools including a plurality of shaped charge perforating guns and a plurality of bi-directional explosive transfer subassemblies. When it is desired to perforate formation 14, work string 30 is lowered through casing 34 until the shaped charge perforating guns are properly positioned relative to formation 14. Thereafter, the shaped charge perforating guns are sequentially fired such that the shaped charges are detonated. Upon detonation, the liners of the shaped charges form jets that create a spaced series of perforations extending outwardly through casing 34, cement 36 and into formation 14.

In the illustrated embodiment, wellbore 32 has an initial, generally vertical portion 38 and a lower, generally deviated portion 40 which is illustrated as being horizontal. It should be noted, however, by those skilled in the art that the shaped charge perforating guns and the bi-directional explosive transfer subassemblies of the present invention are equally well-suited for use in other well configurations including, but not limited to, inclined wells, wells with restrictions, non-deviated wells and the like.

Work string 30 includes a retrievable packer 42 which may be sealingly engaged with casing 34 in vertical portion 38 of wellbore 32. At the lower end of work string 30 is a gun string, generally designated 44. In the illustrated embodiment, gun string 44 has at its upper or near end a ported nipple 46 below which is a time domain firer 48. Time domain firer 48 is disposed at the upper end of a tandem gun set 50 including first and second guns 52 and 54. In the illustrated embodiment, a plurality of such gun sets 50, each including a first gun 52 and a second gun 54 are utilized. Each gun set 50 may have at least one orienting fin (not pictured) extending therefrom to insure that the gun set is disposed off-center with regard to casing 34 as described in U.S. Pat. No. 5,603,379 issued to Halliburton Company on Feb. 18, 1997, which is hereby incorporated by reference. While tandem gun sets 50 have been described, it should be understood by those skilled in the art that any arrangement of guns may be utilized in conjunction with the bi-directional explosive transfer subassemblies 56 of the present invention.

Specifically, between each gun set 50 is a bi-directional explosive transfer subassembly 56 which serves as a connector for connecting adjacent gun sets 50 together. As will be discussed in detail below, each bi-directional explosive transfer subassembly 56 has a ball and socket joint that allows adjacent tandem gun sets 50 to not only rotate relative to one another, but also, be angularly displaced relative to one another, which allows gun string 44 to be connected, deployed, oriented and fired in deviated wells. At the far end of gun string 44 is another time domain firer 58 that is attached to a second gun 54. The other end of time domain firer 58 is attached to a ported closure 60.

Figure 2:
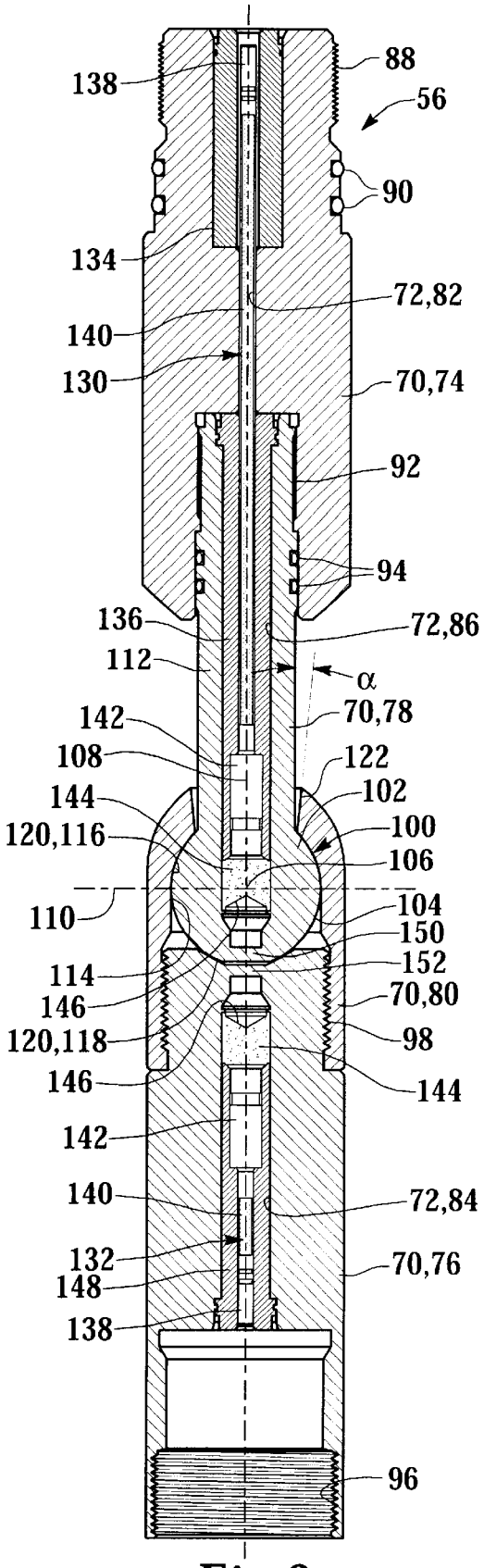
FIG. 2 is a half sectional view of a bi-directional explosive transfer subassembly of the present invention prior to transferring the explosive.

Referring now to FIG. 2, each bi-directional explosive transfer subassembly 56 has a housing 70 defining a housing cavity 72 therein. Housing 70 includes an upper housing portion 74, a lower housing portion 76 and a pair of intermediate housing portions 78, 80. Upper housing portion 74 defines an upper housing cavity portion 82 which is a part of housing cavity 72. Lower housing portion 76 defines a lower housing cavity portion 84, which is also a part of housing cavity 72. Intermediate housing portion 78 defines an intermediate housing cavity portion 86, which is also part of housing cavity 72.

It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

Upper housing portion 74 is attached to a second gun 54 of one of the gun sets 50 of FIG. 1 at threaded connection 88. A plurality of O-rings 90, provides sealing engagement between upper housing portion 74 and the corresponding second gun 54. Upper housing portion 74 is attached to intermediate housing portion 78 at threaded connection 92. A plurality of O-rings 94 provides sealing engagement between upper housing portion 74 and intermediate housing portion 78.

Lower housing portion 76 is attached to a first gun 52 of another gun set 50 of FIG. 1 at threaded connection 96. A plurality of O-rings (not pictured) provides sealing engagement between lower housing portion 76 and the corresponding first gun 52. Lower housing portion 76 is attached to intermediate housing portion 80 at threaded connection 98.

The lower end of intermediate housing portion 78 fits within intermediate housing portion 80 and against the top of lower housing portion 76 to form a ball and socket joint 100. Specifically, intermediate housing portion 78 has ball end 102 configured as a portion of a sphere having an external bearing surface 104 which is configured as a portion of a spherical surface centered on a center point 106. The center point 106 is disposed on a pair of axes 108, 110. Ball end 102 is integral with the cylindrical portion 112 of intermediate housing portion 78 such that ball end 102 and cylindrical portion 112 are fixed for movement together.

Intermediate housing portion 80 and the top of lower housing portion 76 form socket 114 of ball and socket joint 100. Socket 114 includes socket wall 116 and socket wall 118 forming a portion of a spherical bearing surface 120 having substantially the same diameter as the spherical external bearing surface 104 of ball end 102. Bearing surface 120 is centered on center point 106. Accordingly, spherical external bearing surface 104 on ball end 102 is in sliding engagement with spherical internal bearing surfaces 120 of socket 114 which allows upper housing portion 74 and intermediate housing portion 78 to not only rotate relative to lower housing portion 76 and intermediate housing portion 80, but also allows relative angular displacement therebetween. The extent of the angular displacement is limited by flange portion 122 that has a conically shaped inner surface having an angle $\alpha$ relative to axis 108.

A first explosive device 130 is disposed in upper housing cavity 82 and intermediate housing cavity 86, which is adapted to provide an explosive transfer between a second gun 54 and lower housing portion 76. Similarly, a second explosive device 132 is disposed in lower housing cavity 84 and is adapted for providing an explosive transfer between a first gun 52 and upper housing portion 74 via intermediate housing portion 78. Second explosive device 132 is substantially identical to first explosive device 130 but is positioned in an opposite direction. As will be further described, first and second explosive devices provide a bi-directional explosive path through housing 70.

First explosive device 130 includes an insert 134 that is held in upper housing cavity 82 and an insert 136 that is held in intermediate housing cavity 86. A booster 138 is disposed in the upper end of insert 134. Booster 138 has a metallic portion that is crimped around one end of a length of detonating cord 140. A detonating cord initiator 142 has a metallic portion that is crimped around the other end of detonating cord 140. Detonating cord initiator 142 is positioned adjacent to shaped charge 144 which has a conical cavity 146 therein. Second explosive device 132 is made of substantially identical components as is first explosive device 130 with the exception that second explosive device 132 only has one insert 148 that houses booster 138, detonating cord 140, detonating cord initiator 142 and shaped charge 144.

Intermediate housing portion 78 has a wall portion 150 that closes the lower end of intermediate housing cavity 86. Similarly, lower housing portion 76 has a wall portion 152 that closes the upper end of lower housing cavity 84. Thus, wall portions 150 and 152 are adjacent to one another. It will be seen that wall portions 150 and 152 separate intermediate and lower housing cavities 86 and 84 of housing cavity 72. In one embodiment, but not by way of limitation, intermediate and lower housing portions 78 and 76 are made of steel, and thus, wall portions 150 and 152 provide a steel barrier between first and second explosive devices 130 and 132.

Figure 4:
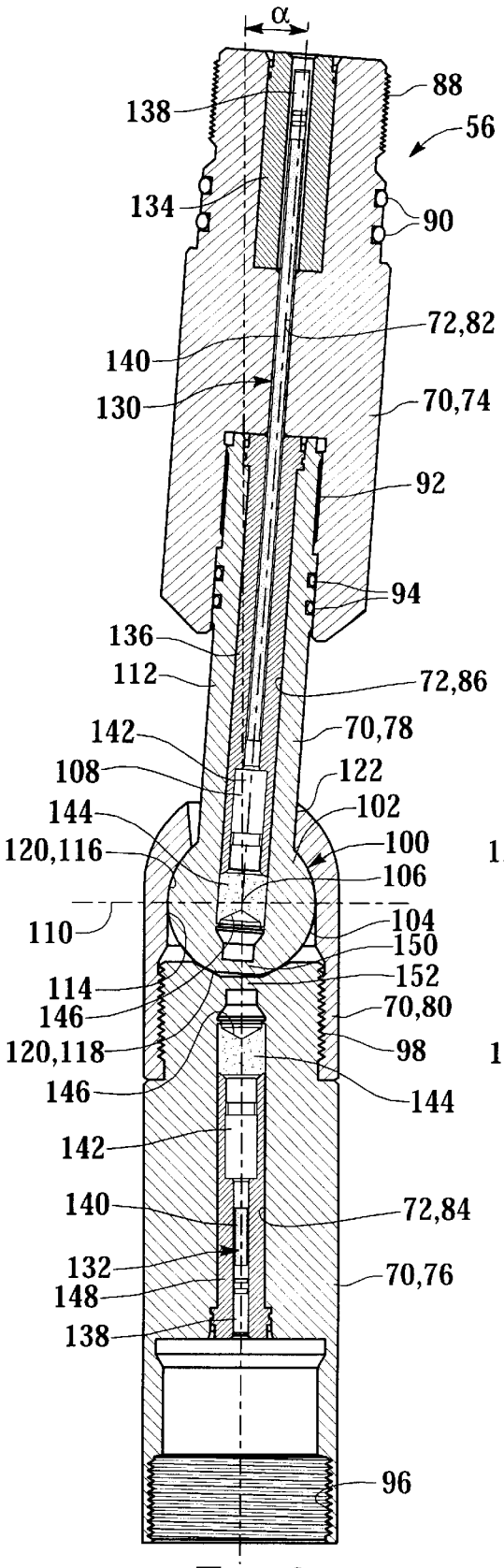
FIG. 4 is a half sectional view of a bi-directional explosive transfer subassembly of the present invention prior to transferring the explosive and with first and second sections of the bi-directional explosive transfer subassembly angularly displaced relative to one another.

In operation, work string 30 with gun string 44 forming a lower end thereof is run into in casing 34 of wellbore 32. In the case of a deviated wellbore or a wellbore with restrictions, use of bi-directional explosive transfer subassemblies 56 improves the deployability of gun string 44 by allowing gun string 44 to bend during such deployment. Specifically, as best illustrated in FIG. 4, as gun string 44 is run into wellbore 32, bi-directional explosive transfer subassemblies 56 provide for angular displacement between upper housing portion 74 and lower housing portion 76 via ball and socket joint 100, thereby reducing bending moments in gun string 44 during deployment which could damage gun string 44. In addition, use of bi-directional explosive transfer subassemblies 56 allows gun string 44 to be deployed in certain deviated wellbores into which gun string 44 could otherwise not be deployed. As illustrated, the maximum angular displacement is defined by angle $\alpha$, which may be between about 1 and about 10 degrees and which is preferable about 5 degrees. It should be noted that angle $\alpha$ could also be greater than 10 degrees but through the use of multiple bi-directional explosive transfer subassemblies 56, such large angular displacements are not typically required and may in fact cause deployment problems in certain wellbore configurations.

As illustrated in FIG. 1, first and second guns 52 and 54 of gun sets 50 have a plurality of perforating charges which are equally angularly disposed around a longitudinal axis of the guns. In this way, a plurality of substantially evenly distributed perforations may be made through casing 34, in cement 36 and into formation 14. On many occasions, however, it is desirable to have the perforations be more specifically directed. For example, but not by way of limitation, it may be desirable to have the perforations directed mostly downwardly and located in the lower half of casing 34. Orienting fins (not pictured) can be used in conjunction with bi-directional explosive transfer subassemblies 56 to help orient gun sets 50 so that the perforation charges are mostly downwardly directed. Specifically, as upper housing portion 74 and lower housing portion 76 of bi-direction explosive transfer subassemblies 56 may rotate relative to one another at ball and socket joint 100, gun sets 50 are substantially self-orienting when used in conjunction with orienting fins.

Figure 3:
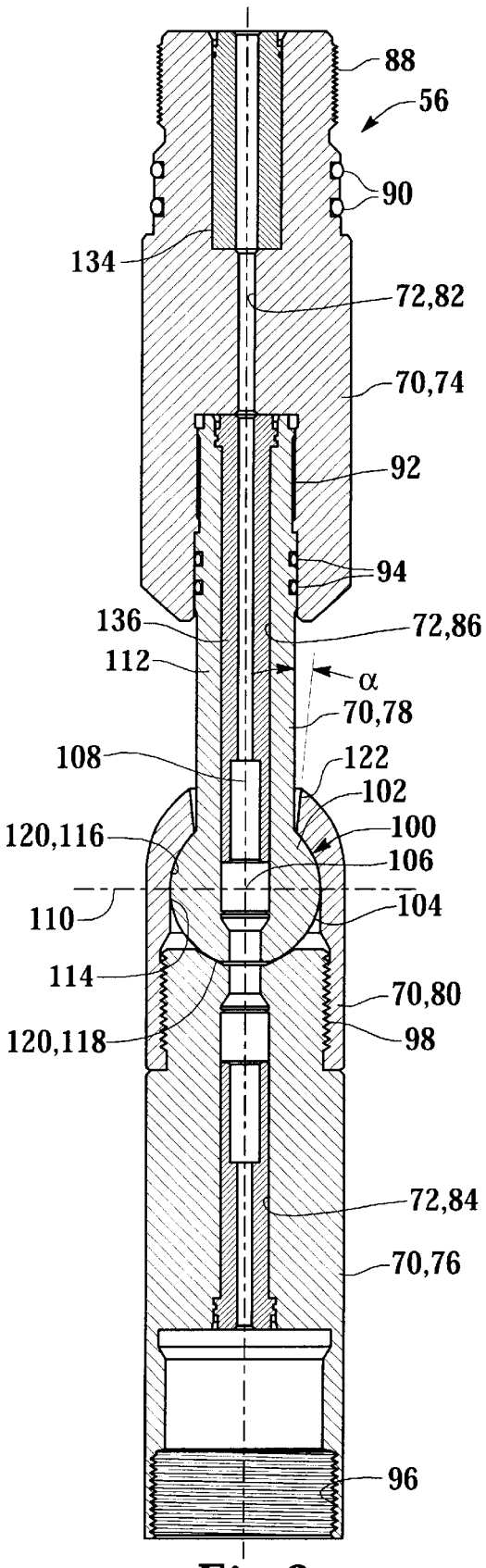
FIG. 3 is a half sectional view of a bi-directional explosive transfer subassembly of the present invention after transferring the explosive.

Once gun string 44 has been fully deployed, as seen in FIG. 1, the perforation process may begin. In a perforating operation, a firing head, such as time domain firer 48, is actuated to initiate the uppermost first gun 52 of the uppermost gun set 50. First gun 52 will then trigger its corresponding second gun 54 which will in turn detonate booster 138 in the uppermost bi-directional explosive transfer subassembly 56. The explosive powder in booster 138 initiates detonating cord 140 which in turn initiates detonating cord initiator 142. This subsequently detonates shaped charge 144 which is shaped to send a jet toward wall portion 150. This explosive jet is sufficient to penetrate through the barrier formed by wall portions 150 and 152 and initiate the facing shaped charge 144 in second explosive device 132. The explosive transfer occurs through second explosive device 132 in reverse order from that just described for first explosive device 130 resulting in the configuration seen in FIG. 3. Eventually, a firing device in the first gun 52 attached to lower housing portion 76 is initiated. This sequence is repeated through the other gun sets 50 and bi-directional explosive transfer subassemblies 56, eventually firing the lowermost second gun 54, assuming that there is no break in the firing sequence.

There may be occasions when it will be desirable to initiate gun string 44 from the far end. In this event, a firing head, such as time domain firer 58, is fired which initiates the firing of the lowermost second gun 54 which in turn triggers the lowermost first gun 52 to fire. The lowermost first gun 52 initiates second explosive device 132 in the lowermost bi-directional explosive transfer subassembly 56. The explosive transfer in this case follows an upward path through bi-directional explosive transfer subassembly 56 to detonate the next gun set 56. This sequence is repeated upwardly until the uppermost gun set 50 is fired. Since bi-directional explosive transfer subassembly 56 carries essentially identical first and second explosive devices 130 and 132 disposed therein and facing one another, it will be seen that bi-directional explosive transfer subassembly 56 is bi-directional, allowing firing from the top down or from the bottom up.

Figure 5:
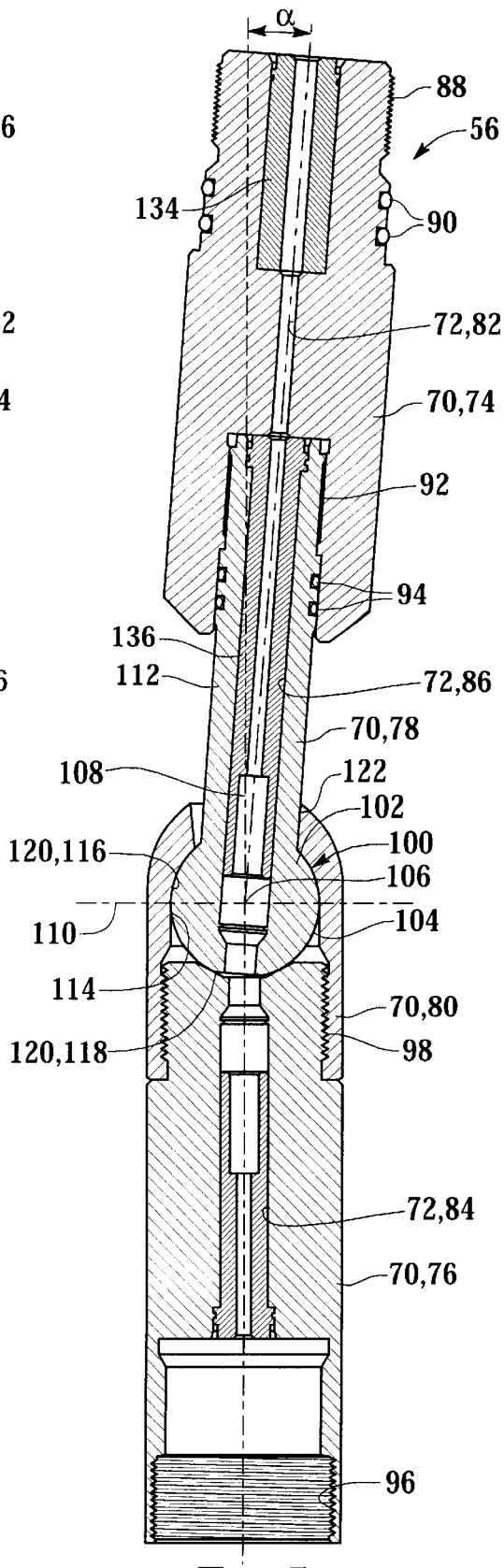
FIG. 5 is a half sectional view of a bi-directional explosive transfer subassembly of the present invention after transferring the explosive and with first and second sections of the bi-directional explosive transfer subassembly angularly displaced relative to one another.

As described, this bi-directional firing capability allows the operator to select between firing gun string 44 from the top or the bottom. Also, if there is a misfire in one direction, gun string 44 may be then triggered from the other direction to fire the remaining guns, assuming there is not an additional misfire. Thus, the gun string 44 allows for one misfire situation without the necessity of removing the entire work string 30 from casing 34. In addition, as best seen in FIG. 5, even if a bi-directional explosive transfer subassembly 56 is in an angularly displaced configuration, the explosive transfer function is nonetheless achieved as the jet formed from the first shaped charge 144 that is fired penetrates through wall portions 150 and 152 to initiate the facing shaped charge 144 even at the maximum angular displacement of angle $\alpha$.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A bi-directional explosive transfer subassembly for coupling two explosive tools comprising:

a first explosive carrying member having a ball end and a first explosive cavity that extends into the ball end;

a second explosive carrying member having a socket and a second explosive cavity, the ball end of the first explosive carrying member slidingly received in the socket of the second explosive carrying member such that the first and second explosive carrying members are rotatable and angularly displaceable relative to one another;

a first explosive device disposed in the first explosive cavity; and a second explosive device disposed in the second explosive cavity and spaced from the first explosive device such that when one of the first and second explosive devices is initiated, the other of the first and second explosive devices will in turn be initiated.

2. The bi-directional explosive transfer subassembly as recited in claim 1 wherein the first explosive device further includes a first shaped charge and the second explosive device further includes a second shaped charge and wherein the first and second shaped charges face one another and are each adapted for sending an explosive jet toward the other shaped charge, thereby providing an explosive transfer therebetween.

3. The bi-directional explosive transfer subassembly as recited in claim 1 wherein the first and second explosive cavities are separated by portions of the first and second explosive carrying members.

4. The bi-directional explosive transfer subassembly as recited in claim 1 wherein the first explosive carrying member further comprises a first wall portion and the second explosive carrying member further comprises a second wall portion that is adjacent to the first wall portion, thereby separating the first and second explosive cavities.

5. The bi-directional explosive transfer subassembly as recited in claim 1 wherein each of the first and second explosive devices further comprises a booster, a length of detonating cord connected to the booster and a detonating cord initiator connected to the detonating cord.

6. The bi-directional explosive transfer subassembly as recited in claim 1 wherein the first explosive carrying member further includes a cylindrical portion extending integrally from the ball end and wherein the second explosive carrying member has a flange portion extending from the socket, the flange portion having a conically shaped inner surface having an angle relative to a longitudinal axis of the second explosive carrying member that defines the maximum angular displacement between the first and second explosive carrying members when the cylindrical portion of the first explosive carrying member contacts the flange portion of the second explosive carrying member.

7. The bi-directional explosive transfer subassembly as recited in claim 1 wherein the maximum angular displacement between the first and second explosive carrying members is between about 1 and about 10 degrees.

8. The bi-directional explosive transfer subassembly as recited in claim 1 wherein the maximum angular displacement between the first and second explosive carrying members is about 5 degrees.

9. A bi-directional explosive transfer subassembly for coupling two explosive tools comprising:

a first explosive carrying member having a ball end and a first explosive cavity that extends into the ball end;

a second explosive carrying member having a socket and a second explosive cavity, the ball end of the first explosive carrying member slidingly received in the socket of the second explosive carrying member such that the first and second explosive carrying members are rotatable and angularly displaceable relative to one another;

a first explosive device including a first shaped charge disposed in the ball end of the first explosive cavity; and a second explosive device including a second shaped charge disposed in the second explosive cavity and spaced from the first explosive device wherein the first and second shaped charges face one another and are each adapted for sending an explosive jet toward the other shaped charge, thereby providing an explosive transfer therebetween.

10. The bi-directional explosive transfer subassembly as recited in claim 9 wherein the first and second explosive cavities are separated by portions of the first and second explosive carrying members.

11. The bi-directional explosive transfer subassembly as recited in claim 9 wherein the first explosive carrying member further comprises a first wall portion and the second explosive carrying member further comprises a second wall portion that is adjacent to the first wall portion, thereby separating the first and second explosive cavities.

12. The bi-directional explosive transfer subassembly as recited in claim 9 wherein each of the first and second explosive devices further comprises a booster, a length of detonating cord connected to the booster and a detonating cord initiator connected to the detonating cord.

13. The bi-directional explosive transfer subassembly as recited in claim 9 wherein the first explosive carrying member further includes a cylindrical portion extending integrally from the ball end and wherein the second explosive carrying member has a flange portion extending from the socket, the flange portion having a conically shaped inner surface having an angle relative to a longitudinal axis of the second explosive carrying member that defines the maximum angular displacement between the first and second explosive carrying members when the cylindrical portion of the first explosive carrying member contacts the flange portion of the second explosive carrying member.

14. The bi-directional explosive transfer subassembly as recited in claim 9 wherein the maximum angular displacement between the first and second explosive carrying members is between about 1 and about 10 degrees.

15. The bi-directional explosive transfer subassembly as recited in claim 9 wherein the maximum angular displacement between the first and second explosive carrying members is about 5 degrees.

16. A well perforating apparatus comprising:

first and second perforating guns; and a bi-directional explosive transfer subassembly interconnecting the first and second perforating guns, the bi-directional explosive transfer subassembly comprising:

a first explosive carrying member coupled to the first perforating gun, the first explosive carrying member having a ball end and a first explosive cavity that extends into the ball end;

a second explosive carrying member coupled to the second perforating gun, the second explosive carrying member having a socket and a second explosive cavity, the ball end of the first explosive carrying member slidingly received in the socket of the second explosive carrying member such that the first and second explosive carrying members are rotatable and angularly displaceable relative to one another; and first and second explosive devices disposed respectively in the first and second explosive cavities and spaced apart such that when one of the first and second explosive devices is initiated, the other of the first and second explosive devices will in turn be initiated, thereby transferring explosive between the first and second perforating guns.

17. The apparatus as recited in claim 16 wherein the first explosive device further includes a first shaped charge and the second explosive device further includes a second shaped charge and wherein the first and second shaped charges face one another and are each adapted for sending an explosive jet toward the other shaped charge, thereby providing an explosive transfer therebetween.

18. The apparatus as recited in claim 16 wherein the first and second explosive cavities are separated by portions of the first and second explosive carrying members.

19. The apparatus as recited in claim 16 wherein the first explosive carrying member further comprises a first wall portion and the second explosive carrying member further comprises a second wall portion that is adjacent to the first wall portion, thereby separating the first and second explosive cavities.

20. The apparatus as recited in claim 16 wherein each of the first and second explosive devices further comprises a booster, a length of detonating cord connected to the booster and a detonating cord initiator connected to the detonating cord.

21. The apparatus as recited in claim 16 wherein the first explosive carrying member further includes a cylindrical portion extending integrally from the ball end and wherein the second explosive carrying member has a flange portion extending from the socket, the flange portion having a conically shaped inner surface having an angle relative to a longitudinal axis of the second explosive carrying member that defines the maximum angular displacement between the first and second explosive carrying members when the cylindrical portion of the first explosive carrying member contacts the flange portion of the second explosive carrying member.

22. The apparatus as recited in claim 16 wherein the maximum angular displacement between the first and second explosive carrying members is between about 1 and about 10 degrees.

23. The apparatus as recited in claim 16 wherein the maximum angular displacement between the first and second explosive carrying members is about 5 degrees.

24. A method of perforating a well comprising the steps of:

deploying a string of perforating guns in a wellbore, the string having first and second perforating guns with a bi-directional explosive transfer subassembly disposed therebetween, the bi-directional explosive transfer subassembly comprising a first explosive carrying member having a ball end and a first explosive cavity that extends into the ball end and a second explosive carrying member having a socket and a second explosive cavity, the first and second explosive carrying members are rotatable and angularly displaceable relative to one another, the first and second explosive carrying members respectively carrying first and second explosive devices;

firing one of the first and second perforating guns;

igniting one of the first and second explosive devices;

igniting the other of the first and second explosive devices; and firing the other of the first and second perforating guns, thereby transferring the explosive and sequentially firing the string of perforating guns.

25. The method as recited in claim 24 wherein the step of rotatably and angularly displacing the first and second explosive carrying members relative to one another further comprises slidingly receiving a ball end of the first explosive carrying member within a socket of the second explosive carrying member.

26. The method as recited in claim 24 wherein the step of igniting one of the first and second explosive devices further comprises igniting a first shaped charge and wherein the step of igniting the other of the first and second explosive devices further comprises igniting a second shaped charge in response to an explosive jet of the first shaped charge.

27. The method as recited in claim 24 further comprising the step of separating the first and second explosive cavities with portions of the first and second explosive carrying members.

28. The method as recited in claim 24 further comprising the step of defining the maximum angular displacement between the first and second explosive carrying members to be between about 1 and about 10 degrees.

29. The method as recited in claim 24 further comprising the step of defining the maximum angular displacement between the first and second explosive carrying members to be about 5 degrees.

30. An explosive transfer subassembly for coupling two explosive tools comprising:

a first explosive carrying member having a ball end and a first explosive cavity that extends into the ball end;

a second explosive carrying member having a socket and a second explosive cavity, the ball end of the first explosive carrying member slidingly received in the socket of the second explosive carrying member such that the first and second explosive carrying members are rotatable and angularly displaceable relative to one another;

a first explosive device disposed in the first explosive cavity; and a second explosive device disposed in the second explosive cavity and spaced from the first explosive device such that when the second explosive devices is initiated, the first explosive devices will in turn be initiated.

31. The explosive transfer subassembly as recited in claim 30 wherein the second explosive device further includes a shaped charge and wherein the shaped charge faces the first explosive device and is adapted for sending an explosive jet toward the first explosive device, thereby providing an explosive transfer therebetween.

32. The explosive transfer subassembly as recited in claim 30 wherein the first explosive carrying member further comprises a first wall portion and the second explosive carrying member further comprises a second wall portion that is adjacent to the first wall portion, thereby separating the first and second explosive cavities.

33. The explosive transfer subassembly as recited in claim 30 wherein the first explosive carrying member further includes a cylindrical portion extending integrally from the ball end and wherein the second explosive carrying member has a flange portion extending from the socket, the flange portion having a conically shaped inner surface having an angle relative to a longitudinal axis of the second explosive carrying member that defines the maximum angular displacement between the first and second explosive carrying members when the cylindrical portion of the first explosive carrying member contacts the flange portion of the second explosive carrying member.

34. The explosive transfer subassembly as recited in claim 30 wherein the maximum angular displacement between the first and second explosive carrying members is between about 1 and about 10 degrees.

35. The explosive transfer subassembly as recited in claim 30 wherein the maximum angular displacement between the first and second explosive carrying members is about 5 degrees.

36. A well perforating apparatus comprising:

first and second perforating guns; and an explosive transfer subassembly interconnecting the first and second perforating guns, the explosive transfer subassembly comprising:

a first explosive carrying member coupled to the first perforating gun, the first explosive carrying member having a ball end and a first explosive cavity that extends into the ball end;

a second explosive carrying member coupled to the second perforating gun, the second explosive carrying member having a socket and a second explosive cavity, the ball end of the first explosive carrying member slidingly received in the socket of the second explosive carrying member such that the first and second explosive carrying members are rotatable and angularly displaceable relative to one another; and first and second explosive devices disposed respectively in the first and second explosive cavities and spaced apart such that when the second explosive device is initiated, the first explosive device will in turn be initiated.

37. The well perforating apparatus as recited in claim 36 wherein the second explosive device further includes a shaped charge and wherein the shaped charge faces the first explosive device and is adapted for sending an explosive jet toward the first explosive device, thereby providing an explosive transfer therebetween.

38. The well perforating apparatus as recited in claim 36 wherein the first explosive carrying member further comprises a first wall portion and the second explosive carrying member further comprises a second wall portion that is adjacent to the first wall portion, thereby separating the first and second explosive cavities.

39. The well perforating apparatus as recited in claim 36 wherein the first explosive carrying member further includes a cylindrical portion extending integrally from the ball end and wherein the second explosive carrying member has a flange portion extending from the socket, the flange portion having a conically shaped inner surface having an angle relative to a longitudinal axis of the second explosive carrying member that defines the maximum angular displacement between the first and second explosive carrying members when the cylindrical portion of the first explosive carrying member contacts the flange portion of the second explosive carrying member.

40. The well perforating apparatus as recited in claim 36 wherein the maximum angular displacement between the first and second explosive carrying members is between about 1 and about 10 degrees.

41. The well perforating apparatus as recited in claim 36 wherein the maximum angular displacement between the first and second explosive carrying members is about 5 degrees.

* * * * *

UNITED STATES PATENT AND TRADEMARK OFFICE

CERTIFICATE OF CORRECTION

PATENT NO. : 6,684,954 B2
DATED : February 3, 2004
INVENTOR(S) : Flint R. George It is certified that error appears in the above-identified patent and that said Letters Patent is hereby corrected as shown below:

Column 11,
Lines 36 and 37, “devices” should read -- device --.

Signed and Sealed this

Twentieth Day of April, 2004

JON W. DUDAS
*Acting Director of the United States Patent and Trademark Office*